US011661684B2

(12) United States Patent
Bowles

(10) Patent No.: US 11,661,684 B2
(45) Date of Patent: May 30, 2023

(54) PLAITED LOW-MELT YARN FOR ADHERING FABRIC

(71) Applicant: Flex Ltd., Singapore (SG)

(72) Inventor: Allison E. Bowles, Boston, MA (US)

(73) Assignee: Flex Ltd., Singapore (SG)

( * ) Notice: Subject to any disclaimer, the term of this patent is extended or adjusted under 35 U.S.C. 154(b) by 399 days.

(21) Appl. No.: 16/728,318

(22) Filed: Dec. 27, 2019

(65) Prior Publication Data

US 2020/0208311 A1 Jul. 2, 2020

Related U.S. Application Data

(60) Provisional application No. 62/785,889, filed on Dec. 28, 2018.

(51) Int. Cl.
*D04B 1/18* (2006.01)
*H04R 1/02* (2006.01)

(52) U.S. Cl.
CPC ..... *D04B 1/18* (2013.01); *D10B 2201/02* (2013.01); *H04R 1/023* (2013.01)

(58) Field of Classification Search
CPC . D04B 1/16; D04B 1/18; D04B 1/225; D04B 21/16; D04B 21/18
See application file for complete search history.

(56) References Cited

U.S. PATENT DOCUMENTS 2,460,674 A 2/1949 Bihaly
2,608,078 A * 8/1952 Anderson ..... D04B 1/246 66/200
4,745,912 A 5/1988 McMurray
8,069,692 B2 * 12/2011 Chung ..... D04B 1/16 66/172 R (Continued)

FOREIGN PATENT DOCUMENTS

| | | |
|---|---|---|
| CN | 105939947 | 9/2016 |
| CN | 107429452 | 12/2017 |
| CN | 108138392 | 6/2018 |

OTHER PUBLICATIONS

International Preliminary Report on Patentability for International (PCT) Patent Application No. PCT/US2019/068733, dated Jul. 8, 2021 8 pages.

(Continued)

*Primary Examiner* — Danny Worrell
(74) *Attorney, Agent, or Firm* — Sheridan Ross P.C.

(57) ABSTRACT

Embodiments of the disclosure provide systems and methods for producing and using a plaited fabric comprising a low-melt yarn for adhering the fabric without a glue adhesive. According to one embodiment, a knitted fabric can comprise a first polymeric yarn of a first material, the first polymeric yarn forming a base of the knitted fabric, and a second polymeric yarn of a second material. The second material can be different from the first material and can have a lower melting temperature than the first material. The first polymeric yarn can be knitted with the second polymeric yarn to form the fabric. Upon an application of heat to the knitted fabric, the second polymeric yarn can form an adhesive and cohesive mechanical attachment to itself and form a tight-knit structural bond within the fabric without the use of a glue adhesive.

18 Claims, 4 Drawing Sheets

(56) References Cited

U.S. PATENT DOCUMENTS

| | | | | |
|---|---|---|---|---|
| 2002/0148258 | A1* | 10/2002 | Cole | A43B 23/0255 66/202 |
| 2004/0074589 | A1 | 4/2004 | Gessler et al. | |
| 2005/0039836 | A1* | 2/2005 | Dugan | D04H 3/14 156/62.2 |
| 2015/0233029 | A1 | 8/2015 | Woodruff et al. | |
| 2016/0251782 | A1* | 9/2016 | Liao | D04B 1/12 66/202 |
| 2017/0036412 | A1 | 2/2017 | Malloy et al. | |
| 2018/0002839 | A1 | 1/2018 | Liao et al. | |

OTHER PUBLICATIONS

International Search Report and Written Opinion for International (PCT) Patent Application No. PCT/US2019/068733, dated Mar. 3, 2020 9 pages.

Search Report (with English translation) for Chinese Patent Application No. 201980086036.7, dated Sep. 21, 2022 15 pages.

Official Action (with English translation) for Chinese Patent Application No. 201980086036.7, dated Sep. 27, 2022 20 pages.

* cited by examiner

PLAITED LOW-MELT YARN FOR ADHERING FABRIC

CROSS REFERENCE TO RELATED APPLICATION

The present application claims the benefits of and priority, under 35 U.S.C. § 119(e), to U.S. Provisional Application Number 62/785,889 filed Dec. 28, 2018 by Bowles et. al. and entitled "Plated Low Melt Yarn for Adhering Fabric" of which the entire disclosure is incorporated herein by reference for all purposes.

FIELD OF THE DISCLOSURE

Embodiments of the present disclosure relate generally to methods and systems for producing and using a knitted fabric and more particularly to producing and using a plaited fabric comprising a low-melt yarn for adhering the fabric without a glue adhesive.

BACKGROUND

Many different goods or articles have hard enclosures covered with a fabric for aesthetics or to provide a pleasant tactile feel. For example, various smart speakers and/or audio speakers are covered in while or in part with a fabric. Typically, these fabric covers are affixed to the surface of the article with a glue adhesive. However, glue adhesives are messy and difficult to apply. Hence, there is a need for improved methods and systems for producing and using knitted fabrics.

BRIEF SUMMARY

Embodiments of the disclosure provide systems and methods for producing and using a plaited fabric comprising a low-melt yarn for adhering the fabric without a glue adhesive. According to one embodiment, a knitted fabric can comprise a first polymeric yarn of a first material and a second polymeric yarn of a second material. According to one embodiment, the first polymeric yarn can be knitted with the second polymeric yarn by plaiting.

The first polymeric yarn can form a base of the knitted fabric and can be knitted with the second polymeric yarn to form the fabric. The second material can be different from the first material and can have a lower melting temperature than the first material. For example, the first polymeric yarn can be a polyester-based yarn, a nylon yarn, or a cotton yarn. The second polymeric yarn can comprise a copolyimide yarn such as Grilon K85, for example.

The knitted fabric can be elastic and the first polymeric yarn can move relative to the second polymeric yarn prior to the application of heat to the knitted fabric. Upon application of heat to the knitted fabric, the second polymeric yarn can form an adhesive and cohesive mechanical attachment to itself and form a tight-knit structural bond within the fabric without the use of a glue adhesive.

According to another embodiment, an article can comprise an enclosure forming an external surface of the article, e.g., a speaker. A knit fabric cover can surround at least a portion of the external surface of the article. The knit fabric cover can comprise a first polymeric yarn of a first material and a second polymeric yarn of a second material knitted with the second polymeric yarn to form the fabric. For example, the first polymeric yarn can be knitted with the second polymeric yarn by plaiting.

The first polymeric yarn can form a base of the knitted fabric. The second material can be different from the first material and can have a lower melting temperature than the first material. For example, the first material can be a polyester yarn, a nylon, or cotton. The second material can comprise a copolyimide.

The knitted fabric cover can be elastic and the first polymeric yarn can move relative to the second polymeric yarn prior to the application of heat to the knitted fabric. Thus, the knit fabric cover can be placed over the article and positioned to surround the portion of the external surface of the article before the application of heat to the knit fabric cover. Once in place and upon application of heat to the knit fabric cover, the second polymeric yarn can form an adhesive and cohesive mechanical attachment to itself and form a tight-knit structural bond within the fabric without the use of a glue adhesive.

According to yet another embodiment, a method for producing and using a knitted fabric can comprise plaiting a first polymeric yarn of a first material with a second polymeric yarn of a second material into the knitted fabric. The first polymeric yarn can form a base of the knitted fabric and can be plaited with the second polymeric yarn to form the fabric. The second material can be different from the first material and having a lower melting temperature than the first material. For example, the first material can comprise polyester, nylon, or cotton and the second material can comprise a copolyimide. The knitted fabric can be elastic and the first polymeric yarn can move relative to the second polymeric yarn.

The knitted fabric can be formed into a cover for an article and can be placed over the article. Heat can be applied to the cover. The heat can melt the second polymeric yarn to form an adhesive and cohesive mechanical attachment to itself and form a tight-knit structural bond within the fabric and around the article without the use of a glue adhesive.

Figure 1:
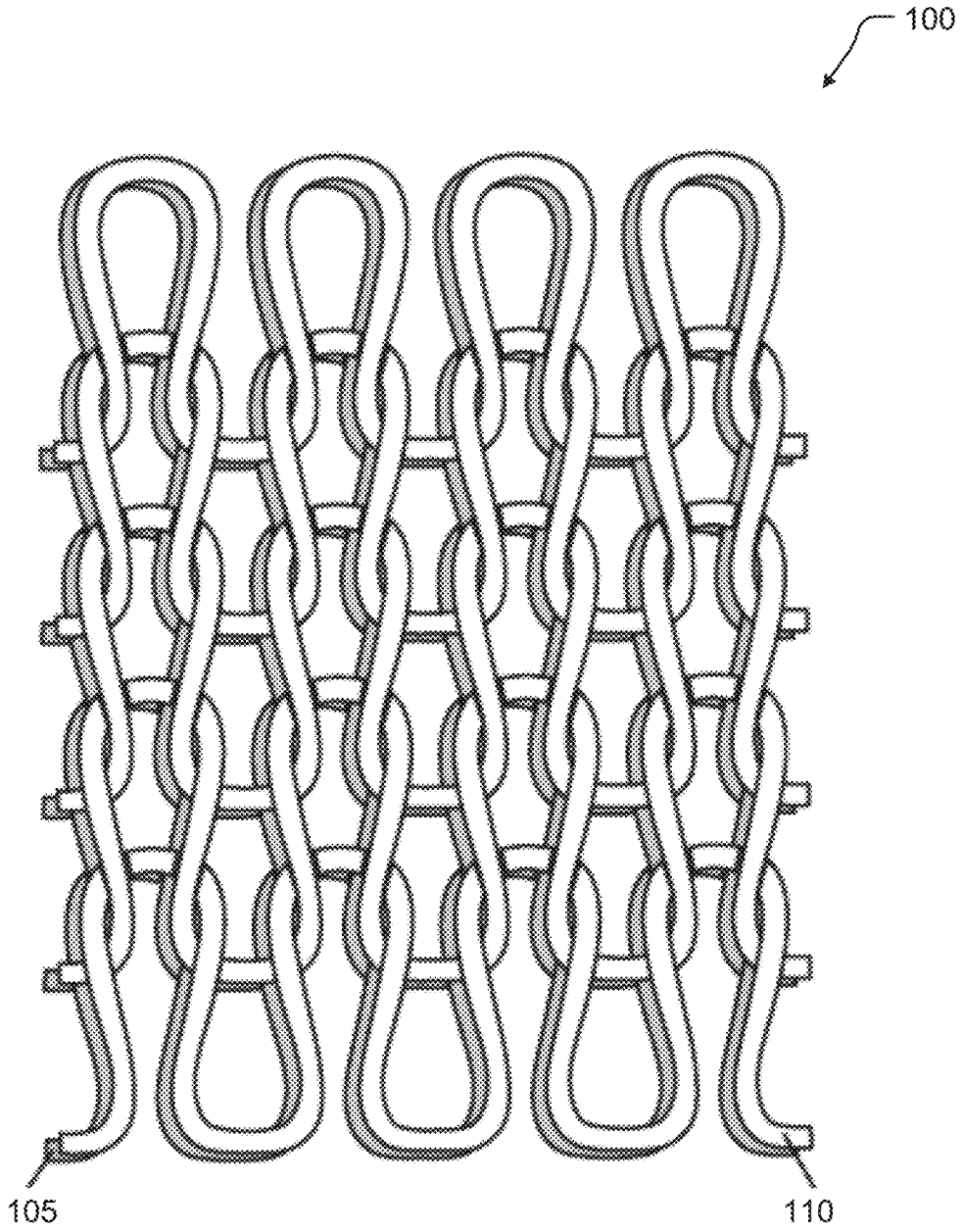
FIG. 1 illustrates a view of a fabric comprising plaited, low-melt yarn according to one embodiment of the present disclosure.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

In the following description, for the purposes of explanation, numerous specific details are set forth in order to provide a thorough understanding of various embodiments disclosed herein. It will be apparent, however, to one skilled in the art that various embodiments of the present disclosure may be practiced without some of these specific details. The ensuing description provides exemplary embodiments only and is not intended to limit the scope or applicability of the disclosure. Furthermore, to avoid unnecessarily obscuring the present disclosure, the preceding description omits a number of known structures and devices. This omission is not to be construed as a limitation of the scopes of the claims. Rather, the ensuing description of the exemplary embodiments will provide those skilled in the art with an enabling description for implementing an exemplary embodiment. It should however be appreciated that the present disclosure may be practiced in a variety of ways beyond the specific detail set forth herein.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

Various additional details of embodiments of the present disclosure will be described below with reference to the figures. While the flowcharts will be discussed and illustrated in relation to a particular sequence of events, it should be appreciated that changes, additions, and omissions to this sequence can occur without materially affecting the operation of the disclosed embodiments, configuration, and aspects.

Embodiments of the present disclosure include a low melt yarn adhesive yarn integrated into the fabric during the knitting process by plating (such is performed in textile knitting constructions) the yarn on one side of the fabric. The fabric can be adhered to a rigid base with heat and pressure rather than glue. In some cases, two dissimilar polymeric yarn materials can be used with one yarn material having a higher melt or Tg than the second polymeric yarn material that when heated the second polymerical yarn material forms an adhesive or cohesive mechanical attachment to itself resulting in a tight knit structural bond, eliminating the need for a glue adhesive application to form the mechanical bond.

For example, in construction, polyester based ground yarn plaited (such is done is performed in textile knitting constructions) with a copolyamide yarn (such as Grilon K85) with material properties for bonding or other materials with similar properties. Other types of ground yarns could include, but are not limited to, Nylon, cotton, and other fibers commonly used in textile constructed goods. The constructed yarn can be woven on a knit machine such as a Shima Seiki SWG091N2 Wholegarment knitting machine. Other machines are available to perform similar operations.

Fabric according to embodiments described herein can maintain elastic properties until thermally activated into desirable rigid position and the fabric can move freely on base for correct positioning before it is adhered. Adhesive can be integrated during the creation of the fabric as opposed to being added as an additional operation. Minimal glue seepage and mess are created during adhering and rigidity can be added to the fabric. Additionally, the fabric can maintain air permeability and acoustic integrity by only applying adhesive where there is yarn. One application of such a fabric can be speaker covers as commonly used in product lines such as those of Sony, Bose, Sonos, Dyson, Sennheiser, and others. Other applications can include but are not limited to audio, automotive, medical, industrial, consumer, home, wearables, aerospace, where fabric encasements and integration is needed.

Figure 2:
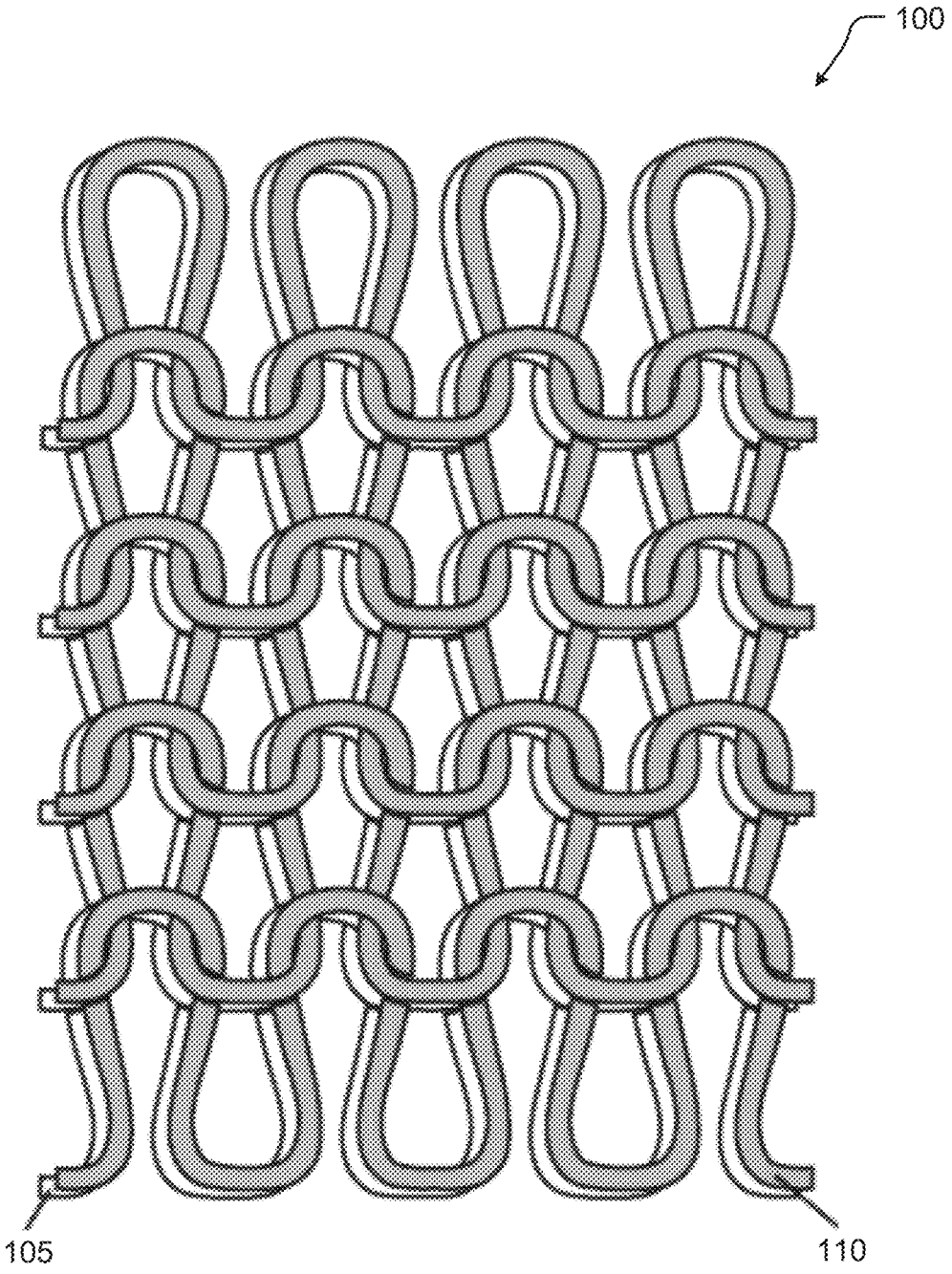
FIG. 2 illustrates another view of a fabric comprising plaited, low-melt yarn according to one embodiment of the present disclosure.

FIG. 1 illustrates a view of a fabric comprising plaited, low-melt yarn according to one embodiment of the present disclosure. FIG. 2 illustrates another view of a fabric comprising plaited, low-melt yarn according to one embodiment of the present disclosure. As illustrated in these example, a knitted fabric 100 can comprise a first polymeric yarn 110 of a first material and a second polymeric yarn 105 of a second material. According to one embodiment, the first polymeric yarn 110 can be knitted with the second polymeric yarn 105 by plaiting.

The first polymeric yarn 110 can form a base of the knitted fabric 100 and can be knitted with the second polymeric yarn 105 to form the fabric. The second material can be different from the first material and can have a lower melting temperature than the first material. For example, the first polymeric yarn 110 can be a polyester-based yarn, a nylon yarn, or a cotton yarn. The second polymeric yarn 105 can comprise a copolyimide yarn such as Grilon K85, for example.

The knitted fabric 100 can be elastic and the first polymeric yarn 110 can move relative to the second polymeric yarn 105 prior to the application of heat to the knitted fabric 100. Upon application of heat to the knitted fabric 100, the second polymeric yarn 105 can form an adhesive and cohesive mechanical attachment to itself and form a tight-knit structural bond within the fabric without the use of a glue adhesive.

Figure 3:
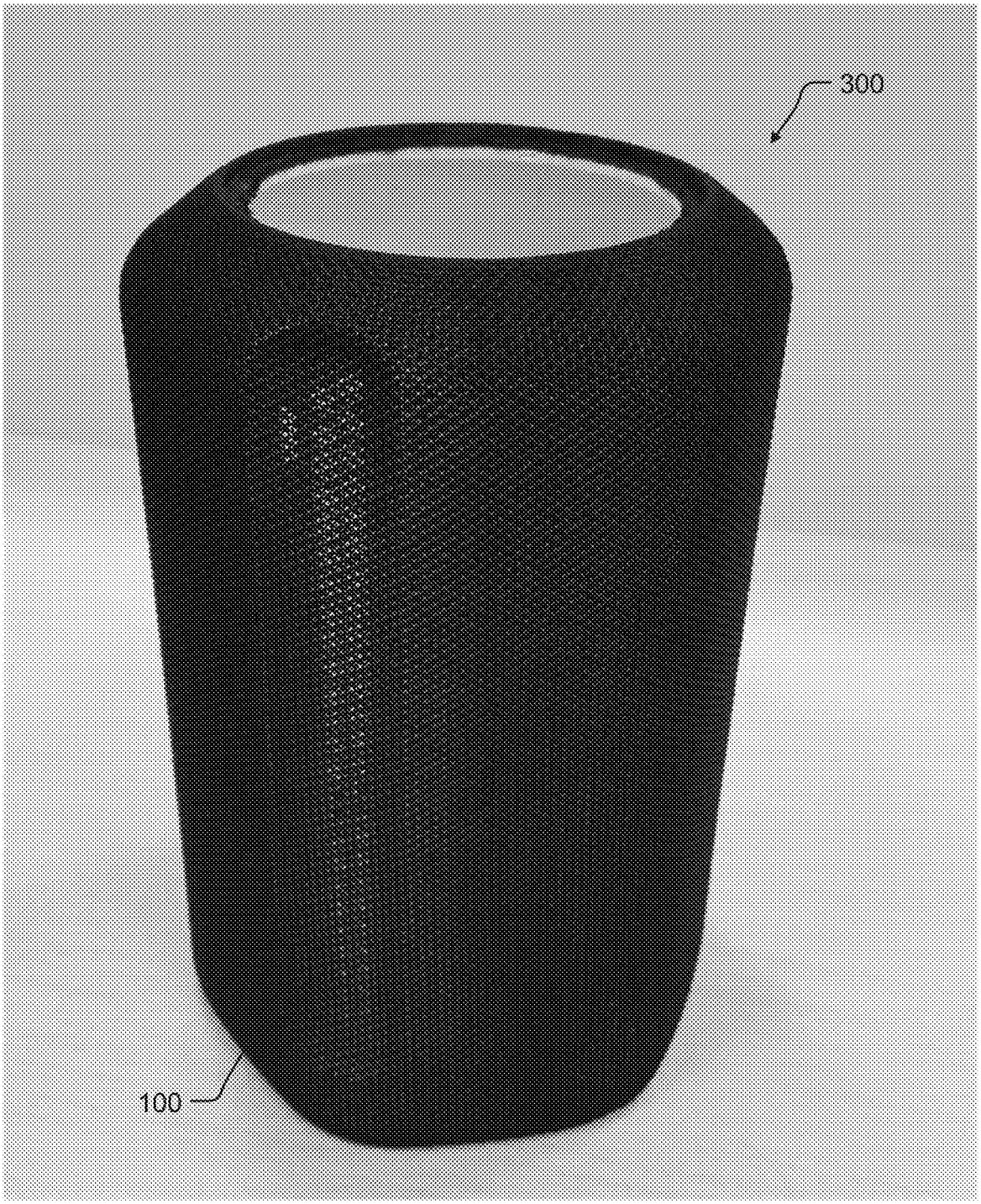
FIG. 3 illustrates an exemplary use of a fabric comprising plaited, low-melt yarn according to one embodiment of the present disclosure.

FIG. 3 illustrates an exemplary use of a fabric comprising plaited, low-melt yarn according to one embodiment of the present disclosure. As illustrated in this example, an article 300 can comprise an enclosure forming an external surface of the article 300, e.g., a speaker. A knit fabric cover can surround at least a portion of the external surface of the article 300. The knit fabric cover can comprise a first polymeric yarn 110 of a first material and a second polymeric yarn 105 of a second material knitted with the second polymeric yarn 105 to form the fabric. For example, the first polymeric yarn 110 can be knitted with the second polymeric yarn 105 by plaiting.

The first polymeric yarn 110 can form a base of the knitted fabric 100. The second material can be different from the first material and can have a lower melting temperature than the first material. For example, the first material can be a polyester yarn, a nylon, or cotton. The second material can comprise a copolyimide.

The knitted fabric 100 cover can be elastic and the first polymeric yarn 110 can move relative to the second polymeric yarn 105 prior to the application of heat to the knitted fabric 100. Thus, the knit fabric cover can be placed over the article 300 and positioned to surround the portion of the external surface of the article 300 before the application of heat to the knit fabric cover. Once in place and upon application of heat to the knit fabric cover, the second polymeric yarn 105 can form an adhesive and cohesive mechanical attachment to itself and form a tight-knit structural bond within the fabric without the use of a glue adhesive.

Figure 4:
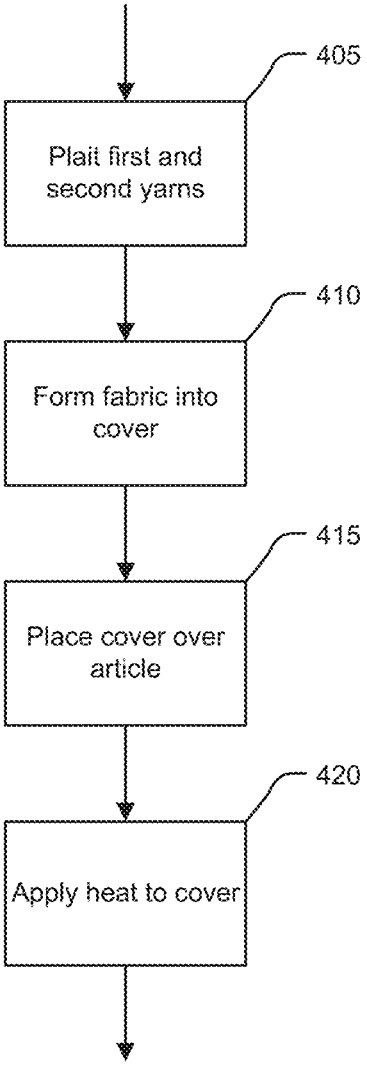
FIG. 4 is a flowchart illustrating an exemplary process for producing and using a knitted fabric according to one embodiment of the present disclosure.

FIG. 4 is a flowchart illustrating an exemplary process for producing and using a knitted fabric according to one embodiment of the present disclosure. As illustrated in this example, producing and using a knitted fabric 100 can comprise plaiting 405 a first polymeric yarn 110 of a first material with a second polymeric yarn 105 of a second material into the knitted fabric 100. The first polymeric yarn 110 can form a base of the knitted fabric 100 and can be plaited with the second polymeric yarn 105 to form the fabric. The second material can be different from the first material and having a lower melting temperature than the first material. For example, the first material can comprise polyester, nylon, or cotton and the second material can comprise a copolyimide. The knitted fabric 100 can be elastic and the first polymeric yarn 110 can move relative to the second polymeric yarn 105.

The knitted fabric 100 can be formed 410 into a cover for an article 300 and can be placed 415 over the article 300. Heat can be applied 420 to the cover. The heat can melt the second polymeric yarn 105 to form an adhesive and cohesive mechanical attachment to itself and form a tight-knit structural bond within the fabric and around the article 300 without the use of a glue adhesive.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A knitted fabric comprising:

a first polymeric yarn of a first material, the first polymeric yarn forming a base of the knitted fabric; and a second polymeric yarn of a second material, the second material being different from the first material and having a lower melting temperature than the first material, the first polymeric yarn knitted with the second polymeric yarn to form the knitted fabric, and upon an application of heat to the knitted fabric, the second polymeric yarn forms an adhesive and cohesive mechanical attachment to itself and forms a tight-knit structural bond within the knitted fabric and onto a surface of an article on which the knitted fabric is installed without the use of a glue adhesive, wherein the knitted fabric is elastic and the first polymeric yarn can move relative to the second polymeric yarn prior to the application of heat to the knitted fabric, and wherein the second polymeric yarn causes the knitted fabric to become rigid after the application of heat to the knitted fabric.

2. The knitted fabric of claim 1, wherein the first polymeric yarn is knitted with the second polymeric yarn by plaiting.

3. The knitted fabric of claim 1, wherein the first polymeric yarn is a polyester-based yarn.

4. The knitted fabric of claim 1, wherein the first polymeric yarn is a nylon yarn.

5. The knitted fabric of claim 1, wherein the first polymeric yarn is a cotton yarn.

6. The knitted fabric of claim 1, wherein the second polymeric yarn comprises a copolyimide yarn.

7. The knitted fabric of claim 6, wherein the copolyimide yarn comprises Grilon K85.

8. An article comprising:

an enclosure forming an external surface of the article; and a knit fabric cover surrounding at least a portion of the external surface of the article, the knit fabric cover comprising a first polymeric yarn of a first material, the first polymeric yarn forming a base of a knitted fabric, and a second polymeric yarn of a second material, the second material being different from the first material and having a lower melting temperature than the first material, the first polymeric yarn knitted with the second polymeric yarn to form the knitted fabric, and upon an application of heat to the knit fabric cover, the second polymeric yarn forms an adhesive and cohesive mechanical attachment to itself and forms a tight-knit structural bond within the knitted fabric and onto the external surface of the article without the use of a glue adhesive, wherein the knitted fabric is elastic and the first polymeric yarn can move relative to the second polymeric yarn prior to the application of heat to the knitted fabric and wherein the second polymeric yarn causes the knitted fabric to become rigid after the application of heat to the knitted fabric.

9. The article of claim 8, wherein the first polymeric yarn is knitted with the second polymeric yarn by plaiting.

10. The article of claim 9, wherein the knit fabric cover is placed over the article and positioned to surround the portion of the external surface of the article before the application of heat to the knit fabric cover.

11. The article of claim 8, wherein the first polymeric yarn is a polyester-based yarn.

12. The article of claim 8, wherein the first polymeric yarn is a nylon yarn.

13. The article of claim 8, wherein the first polymeric yarn is a cotton yarn.

14. The article of claim 8, wherein the second polymeric yarn comprises a copolyimide yarn.

15. The article of claim 13, wherein the article comprises a speaker.

16. A method for producing and using a knitted fabric, the method comprising:

plaiting a first polymeric yarn of a first material with a second polymeric yarn of a second material into the knitted fabric, the first polymeric yarn forming a base of the knitted fabric, the first polymeric yarn plaited with the second polymeric yarn to form the fabric, the second material being different from the first material and having a lower melting temperature than the first material, wherein the knitted fabric is elastic and the first polymeric yarn can move relative to the second polymeric yarn;

forming the knitted fabric into a cover for an article;

placing the cover over the article;

applying heat to the cover, the heat melting the second polymeric yarn forming an adhesive and cohesive mechanical attachment to itself and forming a tight-knit structural bond within the knitted fabric and around the article and onto an external surface of the article without the use of a glue adhesive, wherein the knitted fabric is elastic and the first polymeric yarn can move relative to the second polymeric yarn prior to the application of heat to the knitted fabric and wherein the second polymeric yarn causes the knitted fabric to become rigid after the application of heat to the knitted fabric.

17. The method of claim 16, wherein the first material comprises polyester, nylon, or cotton.

18. The method of claim 17, wherein the second material comprises a copolyimide.

* * * * *